US012331620B2

(12) United States Patent
Guo et al.

(10) Patent No.: US 12,331,620 B2
(45) Date of Patent: Jun. 17, 2025

(54) SELF-GENERATING HEAT PROCESS FOR IN-SITU CONVERSION OF MEDIUM-LOW MATURE AND ORGANIC-RICH SHALE

(71) Applicant: JILIN UNIVERSITY, Jilin (CN)

(72) Inventors: Wei Guo, Jilin (CN); Youhong Sun, Jilin (CN); Chaofan Zhu, Jilin (CN); Qiang Li, Jilin (CN); Sunhua Deng, Jilin (CN); Yuan Wang, Jilin (CN); Zhao Liu, Jilin (CN)

(73) Assignee: Jilin University, Jilin (CN)

( * ) Notice: Subject to any disclaimer, the term of this patent is extended or adjusted under 35 U.S.C. 154(b) by 16 days.

(21) Appl. No.: 18/273,529

(22) PCT Filed: Oct. 19, 2022

(86) PCT No.: PCT/CN2022/126034

§ 371 (c)(1),
(2) Date: Jul. 20, 2023

(87) PCT Pub. No.: WO2023/078085

PCT Pub. Date: May 11, 2023

(65) Prior Publication Data

US 2024/0240548 A1 Jul. 18, 2024

(30) Foreign Application Priority Data

Nov. 3, 2021 (CN) ..... 202111291684.1

(51) Int. Cl.

| | |
|---|---|
| ***E21B 43/243*** | (2006.01) |
| ***E21B 43/16*** | (2006.01) |
| ***E21B 43/30*** | (2006.01) |
| *E21B 43/26* | (2006.01) |

(52) U.S. Cl.
CPC ..... *E21B 43/243* (2013.01); *E21B 43/166* (2013.01); *E21B 43/30* (2013.01); *E21B 43/26* (2013.01)

(58) Field of Classification Search
CPC ..... E21B 43/243; E21B 43/166; E21B 43/30; E21B 43/26
See application file for complete search history.

(56) References Cited

U.S. PATENT DOCUMENTS

| | | | | |
|---|---|---|---|---|
| 4,928,765 | A | 5/1990 | Nielson | |
| 2001/0049342 | A1* | 12/2001 | Passey | E21B 43/243 507/200 |
| 2009/0145598 | A1* | 6/2009 | Symington | E21B 43/30 166/250.01 |
| 2014/0069636 | A1* | 3/2014 | Kaminsky | E21B 36/04 166/248 |
| 2016/0024901 | A1* | 1/2016 | Youhong | C10G 1/02 166/248 |
| 2017/0122087 | A1* | 5/2017 | Niemann | E21B 43/26 |
| 2018/0010434 | A1* | 1/2018 | Kuhlman | E21B 43/2605 |

FOREIGN PATENT DOCUMENTS

| | | | |
|---|---|---|---|
| CN | 101558216 | A | 10/2009 |
| CN | 110005390 | A | 7/2019 |
| CN | 113236210 | A | 8/2021 |
| WO | WO 2008/048455 | A2 | 4/2008 |

* cited by examiner

*Primary Examiner* — Silvana C Runyan
(74) *Attorney, Agent, or Firm* — Stites & Harbison PLLC; Richard S. Myers, Jr.; Patrick M. Torre

(57) ABSTRACT

The present disclosure provides a self-generating heat process for in-situ converting medium-low mature and organic-rich shale, and relates to the field of in-situ mining of medium-low mature shale rich in organic matter, the self-generating heat process mainly comprises the following steps: locally preheating the vincinity of an injection well of medium-low mature and organic-rich shale formation with well-reformed reservoir and injecting ambient temperature air into the preheated formation to excite and establish a chemical reaction zone composed of a residue zone, an autogenous heat zone, a thermal cracking zone and a preheating zone. Heat is released by oxidation reaction of residues generated after kerogen thermal cracking, so as to realize convection heating of medium-low mature and organic-rich shale formation. Oil and gas products generated from kerogen thermal cracking enter production wells through fractures and are lifted to the ground surface. Because the in-situ oil shale conversion technology only needs local preheating the vincinity of the injection well and only a small amount of external heat or combustibles injection, the related cost is low.

5 Claims, 7 Drawing Sheets

(a)

(b)

SELF-GENERATING HEAT PROCESS FOR IN-SITU CONVERSION OF MEDIUM-LOW MATURE AND ORGANIC-RICH SHALE

CROSS REFERENCE TO RELATED APPLICATIONS

This application is a § 371 National State Application of PCT/CN2022/0126034, filed Oct. 19, 2022, which claims priority to CN 202111291684.1, filed Nov. 3, 2021, the entire disclosures of which are incorporated herein by this reference.

TECHNICAL FIELD

The invention relates to the field of in-situ mining of medium-low mature shale rich in organic matter, in particular relates to a self-generating heat process for in-situ producing oil from medium-low mature shale rich in organic matter.

BACKGROUND ART

Generally, the hydrocarbon source rocks with maturity Ro less than 1% are called medium-low mature shale rich in organic matter, wherein the detained liquid hydrocarbon substances account for less than 25% of the total oil generation, the organic matter that has not undergone thermal hydrocarbon generation exceeds 40%, which can produce oil and gas products by low temperature retorting. Among them, the medium-low mature and organic-rich shale with maturity less than 0.5% is called oil shale, and its detained liquid hydrocarbon substances are less than 10%. There is great potential for in-situ conversion of medium-low mature and organic-rich shale in China, that is, technically recoverable oil resources are about 70-90 billion tons, the natural gas resources are about 6.0-6.5×$10^4$ billion cubic meters. Among them, the oil contained in oil shale is about 47.644 billion tons. Although the resources of medium-low mature shale rich in organic matter in China are huge, only a small amount of oil shale within 100m depth can be developed and converted by ground retorting technology, and this technology is harmful to the environment. In-situ mining(conversion) technology is such a developing mode that the solid kerogen in shale is cracked into oil and gas in situ by artificially heating the oil shale reservoir, combined with oil production technology, it is mined to the ground surface. This technology has not yet reached the industrial scale, but it has the advantages of environmental protection, small area, low cost and the ability to mine middle and deep shale resources when the technology further grows, which is an important developing trend for medium-low mature and organic-rich shale.

According to the difference of heat source and heat transfer modes, the in-situ mining of medium-low mature and organic-rich shale is mainly realized by physical heating methods, including conductive heating technology, convection heating technology and radiation heating technology. Conductive heating technology (reference can be made to patent CN 87100890) is the most developed in-situ conversion technology by setting a large number of high-power electric heaters in the non-fractured formation and heating the formation by slow heat conduction. The electric heating technology with small well spacing developed by Company Shell has successfully tested in the Green River basin and Jordan with an energy output-to-input ratio of about 3.1. Convection heating technology (reference can be made to patent CN 1676870, CN 107387052B) injects fluids such as high-temperature steam, inert gas and supercritical $CO_2$ into the fractured formation, heats the formation mainly through high-temperature fluid convection, with a faster heating speed. Radiation heating technology (reference can be made to the patent application document CN 106640010A) heats the formation water through underground radio frequency transmitter, so that the oil shale is cracked to produce oil and gas, which is dissolved in near-critical water and circulated to the ground surface through circulation system. This technology has the advantages of high heating efficiency, uniform heating, fast heating speed, small thermal inertia, catalytic effect to chemical reaction, little heat loss in the heat transfer to the bottom of the well, but the underground equipment is complex and the heating range is limited.

In addition, chemical heating technology has also been applied to the in-situ exploitation of oil shale. An underground open combustion convection heating method (reference can be made to patent CN105840162B) proposes that fuel gas and combustion-supporting gas are respectively sent into the well casing through pipelines at the mining area, mixed and burned in the underground burner, and high-pressure air isolates the flame to generate a mixed heating medium to heat the formation, and the heat source directly contacts with the heated substance, thus omitting the process of heat exchange and reducing wellbore heat loss. The above mentioned technology has been proved to be feasible in field practice or laboratory experiment, but it needs to invest a large amount of external heat or combustible gas, which leads to poor economy of in-situ economic mining of medium-low mature shale rich in organic matter. Similarly, a method of extracting oil and gas from oil shale by in-situ local chemical method (reference can be made to patent CN103790563B) proposes that oxygen-containing gas and hydrocarbon gas recovered from production wells are mixed and injected into production wells after heating, forming local chemical reactions in the oil shale layer, inducing local chain reaction to realize thermal cracking of oil shale to produce oil and gas. As a by-product, solid carbon can be reused as waste heat after oil shale exploitation. In addition, a method (reference can be made to patent CN109184649B) for extracting shale oil and gas by biochar-assisted heating oil shale is proposed that proppant mixed with a certain proportion of bio-carbon and initiator is injected into underground fractures with fracturing fluid during fracturing, and then shale oil and gas are extracted by in-situ local chemical extraction from oil shale.

Obviously, in the process of in-situ conversion in the prior art, hydrocarbon gas or biachar is injected and the heat released by its reaction with oxygen is used to heat the low-mature and organic-rich shale formation, while the biochar generated by kerogen pyrolysis is only reused in the form of waste heat, which does not give full play to the calorific value contained in the fixed carbon. In fact, after the medium-low mature and organic-rich shale is heated to the cracking temperature, kerogen macromolecules undergo condensation reaction, and in addition to generating oil and gas products, more than 40% kerogen is converted into solid carbon residue. The oil-generating potential of the solid product is zero, but there is still a large amount of calorific value, which can be burned when ignited in an oxygen-containing atmosphere and generate a large amount of heat. The conventional in-situ conversion technology does not consider the role of the solid substance, and it remains in the formation or is only reused in the form of waste heat. However, if the calorific value is fully utilized, the external energy and energy input of in-situ conversion of medium-low mature and organic-rich shale can be greatly reduced. At the same time, the residue carbon is converted into $CO_2$, which improves the porosity and permeability of solid phase and is beneficial to the generation of oil and gas products.

To sum up, it is urgent to improve the in-situ conversion process of medium-low mature and oraganic-rich shale, and to improve the energy input efficiency and the ultimate oil and gas yield.

SUMMARY OF INVENTION

In view of the above problems existing in the prior art, the aim of the invention is to provide a self-generating heat process for in-situ converting medium-low mature and organic-rich shale, the self-generating heat process mainly comprises the following steps: locally preheating the vincinity of an injection well of medium-low mature and organic-rich shale formation with well-reformed reservoir and injecting ambient temperature air into the preheated formation to excite and establish a chemical reaction zone composed of a residue zone, an autogenous heat zone, a thermal cracking zone and a preheating zone. Heat is released by oxidation reaction of residues generated after kerogen thermal cracking, so as to realize convection heating of medium-low mature and organic-rich shale formation. Oil and gas products generated from kerogen thermal cracking enter production wells through fractures and are lifted to the ground surface. Because the in-situ oil shale conversion technology only needs local preheating the vincinity of the injection well and only a small amount of external heat or combustibles injection, the related cost is low.

The invention is realized by the following technical solutions: A self-generating heat process for in-situ converting medium-low mature and organic-rich shale, which is characterized in that the method comprises the following steps:

Step 1: Determine the target area of self-generating heat in-situ conversion of medium-low mature and organic-rich shale, the formation conditions of the target area are that: vitrinite reflectance of the medium-low mature and organic-rich shale formation is less than 1, oil content of the medium-low mature and organic-rich shale formation is more than 5%, thickness of the medium-low mature and organic-rich shale formation is more than 15m, water content of the medium-low mature and organic-rich shale formation is less than 5% and burial depth of the medium-low mature and organic-rich shale formation is less than 3000m;

Step 2: Arrange a well pattern in the target area as described in step 1, which adopts an inverse nine-point well pattern, wherein the ratio of the injection well pattern to the production well pattern is 3:1;

Step 3: Carry out reservoir reconstruction on the medium-low mature and organic-rich shale formation to form a fracture network, and the permeability ratio of fractures to matrix is less than 10000, the fracture spacing is less than 0.5 meters;

Step 4: After Reservoir Reconstruction, locally preheat the vincinity of the injection well of the medium-low mature and organic-rich shale formation, with the preheating temperature reaching 300° C. and the preheating radius around the injection well reaching 2 m;

Step 5: after preheating, inject ambient temperature air into the injection well, control the bottom pressure of the injection well to be less than 20 MPa, and ensure that the bottom pressure of the production well is the same with the formation fluid pressure, with the injection of ambient temperature air, an autogenous heat reaction is triggered, and along the direction of displacement, a chemical reaction zone consisting of a residue zone, an autogenous heat zone, a thermal cracking zone and a preheating zone in sequence is formed in the middle-low mature and organic-rich shale formation between the injection well and the production well. Heat is released by oxidation reaction of residues generated after kerogen thermal cracking so as to realize convection heating the medium-low mature and organic-rich shale formation. The oil and gas products from pyrolysis of kerogen enter the production wells through fractures, and are lifted to the ground.

Furthermore, when the medium-low mature and organic-rich shale formation has a thickness of more than 50 meters, vertical wells are adopted; when the medium-low mature and organic-rich shale formation has a thickness of less than 50 meters, horizontal wells are adopted.

Further, the reverse nine-point well pattern includes at least one well unit, each of which includes a production well located at the center of the rectangle, and an injection well located at the four vertex positions of the rectangle and four center positions of the four edges of the rectangle.

Furthermore, the well spacing of the reverse nine-point well pattern is less than 50 meters.

Further, the procedure of reservoir reconstructing the medium-low mature and organic-rich shale formation to form a fracture network as described in step 3 is as follows: the medium-low mature and organic-rich shale formation is reconstructed by volume fracturing and shock wave fracturing in turn to form a fracture network.

Further, in Step 4, the locally preheating the vincinity of the injection well of medium-low mature and organic-rich shale formation includes: preheating by injecting high temperature inert gas, steam preheating, electric preheating or preheating by combustion of a mixture of combustible gas and air, preheating time is less than three days, therefore, only a small amount of external heat or combustiles and air mixture is needed for injection, the related cost is low.

Furthermore, the residue zone, the autogenous heat zone, the thermal cracking zone and the preheating zone are divided according to the difference of the temperature profile and the oxygen concentration during the advancing direction in the reaction region.

Among them, in the autogenous heat zone, all the oxygen reacts with the residual carbon, and no oxygen reaches the thermal cracking zone at the front end along the direction of displacement. Only heat reaches the zone through convective heat transfer, so that the kerogen is thermally cracked to produce oil and gas in an oxygen-free environment, while the residual carbon remains in a solid form, which provided heat donor for an oxidation reaction in the autogenous heat zone. The temperature of the thermal crack zone ranges from 300° C. to 450° C. The temperature in the preheating zone is between room temperature and 300° C., and the preheating energy comes from the external heat or the heat released from the underground combustion of combustibles and air. The residue zone is inorganic matter left after the residual carbon is completely oxidized and there is no heat donor in this zone and exothermic reaction cannot occur.

Further, in Step 5, the air injection amount is greater than 140 $m^3/(h \cdot m)$, and the air injection time is until the temperature of the production well reaches ambient temperature.

Further, in Step 5, when the volume fraction of $CO_2$ in the production well is less than 5%, it is necessary to increase the amount of air injected to 560 $m^3/(h \cdot m)$.

Furthermore, in Step 5, when the oil and gas product in the medium-low mature and organic-rich shale formation is blocked, high-temperature air over 300° C. is injected into the injection well to remove the blockage.

Compared with the traditional physical heating method, the self-generating heat process of in-situ conversion the medium-low mature and organic-rich shale provided by the invention has the following advantages:

1. The heat source required for heating the formation is mainly from the shale itself, that is, the residual organic matter after pyrolysis of kerogen gives off heat due to oxidation, so the demand for external energy is low, and correspondingly the energy utilization efficiency is higher;
2. There is Gas Drive in the process of in-situ mining, so the secondary cracking is weak and the heat transfer is fast;
3. All the oxygen in the autogenous heat zone reacts with the residual carbon. The autogenous heat product $CO_2$ can reduce the interfacial tension and the viscosity of oil and water, so the oil yield is high.

ILLUSTRATION OF THE FIGURES

The illustrations herein are intended to provide a further understanding of the invention and constitute a part of the application of the invention. Exemplary embodiments of the invention and their descriptions are provided for understanding the invention and do not constitute an undue limitations of the invention. In the figures:

FIG. 7(*b*) is a cross-sectional view of the sample after the one-dimensional self-generating heat, in-situ conversion simulation reaction in Example 3 of the invention.

Figure 8A:
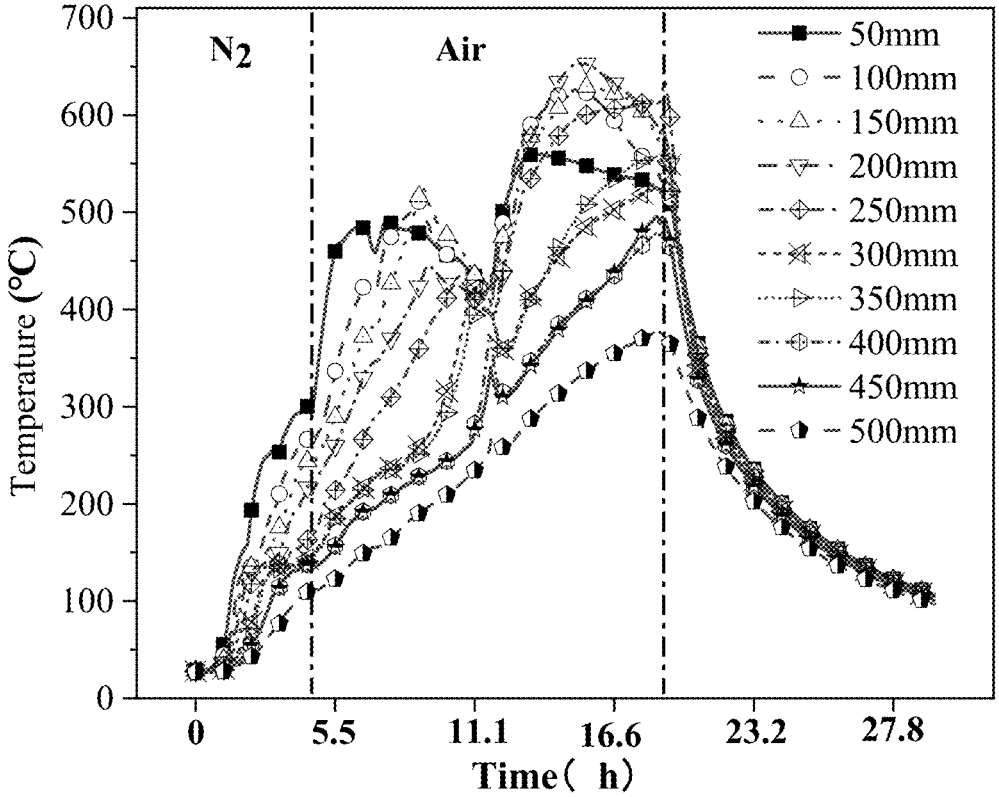
FIG. 8(*a*) is the schematic diagram of the evolution of the temperature field of the one-dimensional self-generating heat in-situ conversion in Example 3 of the present invention.
Figure 8B:
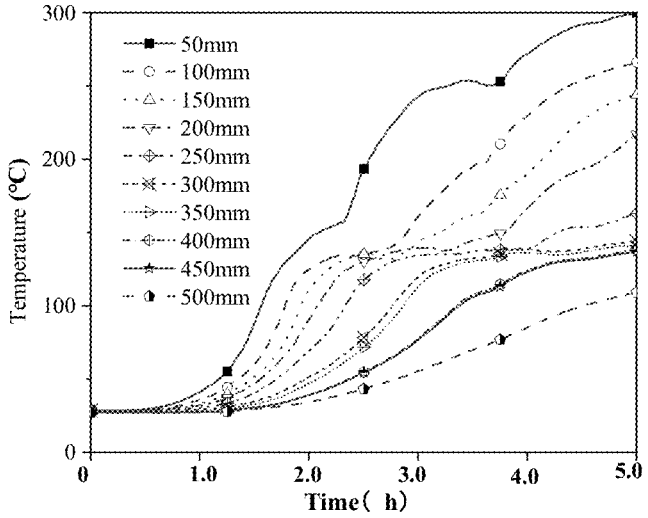

FIG. 8(*b*) presents an isolated portion of FIG. 8 (*a*), in the range of 0 to 5.0 h, for clarity of that portion of the drawing.

In the figures: 1—production well; 2—injection well; 3—residue zone; 4—self—generating heat zone; 5—thermal cracking zone; 6—preheating zone

DETAILED DESCRIPTION OF THE INVENTION

In order to make the aims, features and advantages of the invention more obvious and understandable, the following are combined with the embodiments of the invention and FIGS. 1, 2, 3, 4, 5 and 6, the technical solutions of the invention are described clearly and completely. Obviously, the invention is not limited by the following embodiments, and the concrete implementation method can be determined according to the technical solution and the actual situation of the invention. To avoid confusion with the essence of the invention, the well-known methods, processes and procedures are not described in detail.

Figure 1:
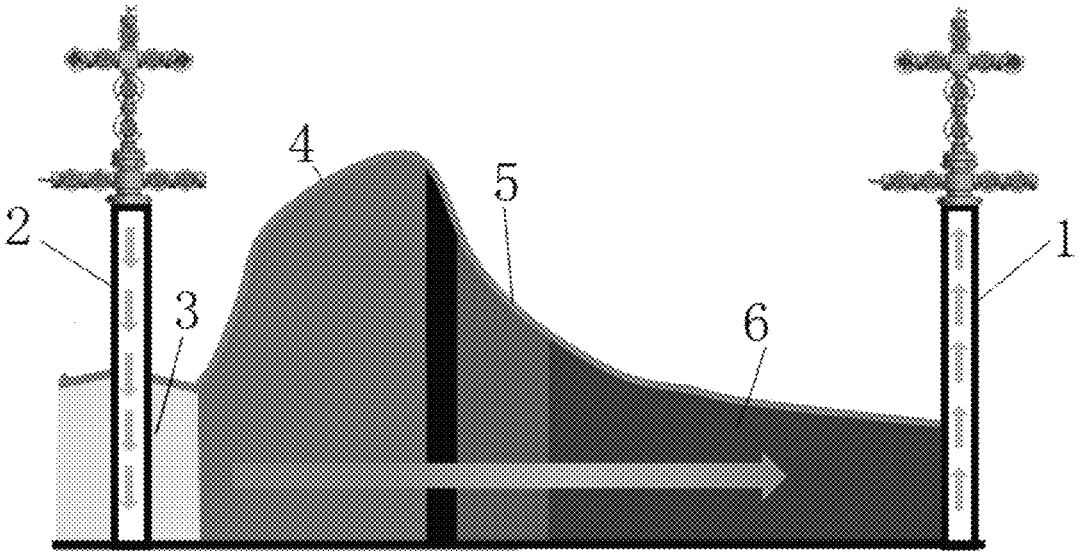
FIG. 1 is a schematic diagram of self-generating heat, in-situ conversion of medium-low mature and organic-rich shale.

A self-generating heat process for in-situ conversion of medium-low mature and organic-rich shale by locally preheating the vincinity of injection well 2 of medium-low mature and organic-rich shale with good reservoir reconstruction, injecting ambient temperature air into the preheated formation to excite and establish a chemical reaction zone consisting of a residue zone 3, an autogenous heat zone 4, a thermal cracking zone 5 and a preheated zone 6, heat is released by oxidation reaction of residues generated after kerogen thermal cracking, so as to realize convection heating of the medium-low mature and organic-rich shale formation. Oil and gas products generated from kerogen thermal cracking enter production well 1 through fractures and are lifted to the ground surface. As shown in FIG. 1, it depicts the principle diagram of self-generating heat and in-situ thermal conversion of medium-low mature and organic-rich shale.

A self-generating heat process for in-situ conversion of medium-low mature organic-rich shale include:

Determine the target area of self-generating heat, in-situ conversion of medium-low mature and organic-rich shale;

The hydrocarbon generation potential, burial depth, thickness and sealing ability of the medium-low mature and organic-rich shale formation determine the oil yield and energy return rate of the self-generating heat, in-situ conversion. Fully understanding and optimizing the target area and formation is the first step for the self-generating heat, in situ conversion of medium-low mature and organic-rich shale.

The stratigraphic conditions of the target area are as follows:

Vitrinite reflectance of the medium-low mature and organic-rich shale formation is less than 1.

The oil content of the medium-low mature and organic-rich shale formation is more than 5%.

The thickness of the medium-low mature and organic-rich shale formation is more than 15 meters.

The water content of the medium-low mature and organic-rich shale formation is less than 5%.

The buried depth of the medium-low mature and organic-rich shale formation is less than 3000m.

Compared with the existing technology, the advantages of adopting the above measures are as follows:

1. The invention has broad application, not only for low maturity oil shale formation (vitrinite reflectance less than 0.5), but also for medium maturity shale oil reservoir (vitrinite reflectance 0.5~1).
2. The invention does not need to completely empty the formation water, the upper limit of the formation water content for the conversion is 5%, and the existence of a small amount of the formation water is favorable for heat transfer and kerogen catalytic pyrolysis.

In order to prevent the invasion of formation water outside the target area during the self-generating heat, in-situ conversion and the loss of oil recovery caused by the flow of oil and gas products out of the target area, well group should be arranged.

Figure 2:
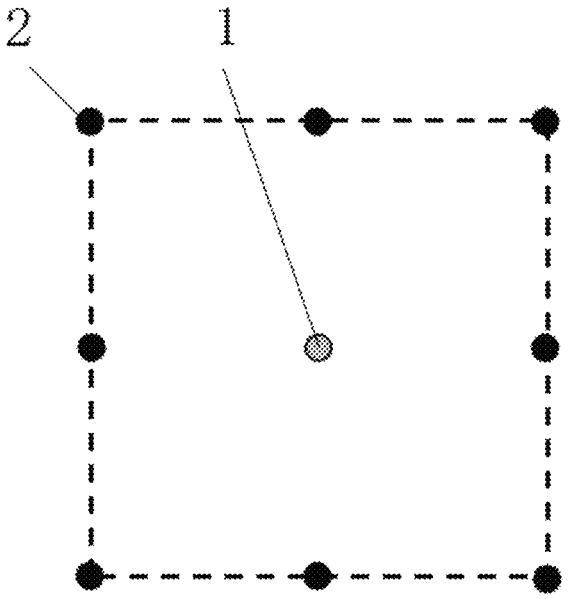
FIG. 2 is a well pattern distribution diagram of self-generating heat, in-situ conversion of medium-low mature and organic-rich shale.

Preferably, the well group of the self-generating heat, in-situ conversion process for the medium-low mature and organic-rich shale is an inverse nine-point well pattern, as detailed in FIG. 2, i.e., well pattern distribution diagram for the self-generating heat, in-situ conversion of medium-low mature and organic-rich shale. Said reverse nine-point well pattern comprises at least one well unit, each well unit comprising a production well 1 located at the center of the rectangle, and an injection well 2 located at the four vertex positions of the rectangle and the four center positions of the four edges of the rectangle.

Preferably, when the medium-low mature and organic-rich shale formation has a thickness of more than 50 meters, vertical wells shall be used, and when the medium-low mature and organic-rich shale formation has a thickness of less than 50 meters, horizontal wells shall be used.

Preferably, the spacing of wells in the well group of the self-generating heat, in-situ conversion process for the medium-low mature and organic-rich shale is less than 50 meters.

Compared with the existing technology, the advantages of adopting the above measures are as follows:

1. The invention selects reverse nine-point well pattern, and the ratio of injection well to production well is 3:1, which ensures sufficient air injection and displacement power and rapid advancement of formation reaction area.
2. The well spacing of self-generating heat, in-situ conversion of medium-low mature and organic-rich shale proposed in the invention is large, the control range of single well group is wide, and the development cost is reduced.

Medium-low mature and organic-rich shale has poor conductivity, and in order to ensure sufficient oxygen supply and smooth flow passage of oil and gas products, it is necessary to fully reconstruct the reservoir sufficiently before the self-generating heat, in-situ conversion. The self-generating heat, in-situ conversion of medium-low mature and organic-rich shale requires a high degree of reservoir reconstruction. There is relationship between conductivity of fractures and of matrix. When the fracture permeability is high, a large amount of heat generated by autogenous heat reaction of matrix is quickly carried away by large flow of gas in the fracture, resulting in the matrix temperature not being able to be maintained at the reaction temperature continuously, so there is a maximum value between the permeability range of fracture and matrix.

Preferably, the reservoir construction of the medium-low mature and organic-rich shale formation includes volume fracturing and shock-wave fracturing in turn, and both volume fracturing and shock-wave fracturing technologies are the existing methods of the existing reservoir fracturing technologies, belonging to the prior art. The specific processes of volume fracturing and shock-wave fracturing are not explained in detail here.

Preferably, the ratio of permeability of fracture to matrix is less than 10000 after the reservoir of the medium-low mature and organic-rich shale formation is reconstructed.

Preferably, the fracture spacing of the medium-low mature and organic-rich shale formation after the reservoir reconstruction is less than 0.5 meters.

Compared with the prior art, adopting the above measures has the following advantages: in the reservoir reconstruction of the invention, large-scale hydraulic fracturing (i.e., large-scale volume fracturing) and shock wave fracturing are successively used to form large fractures (fractures with an opening greater than 1 cm) and micro fractures (fractures with an opening less than 1 cm), and the formation of multi-scale flow channels in the reservoir, which reduces the thermal short circuit and oil-gas displacement efficiency during the in-situ conversion, and greatly improves the oil yield of formation.

The heat released by low-temperature oxidation in the medium-low mature and organic-rich shale formation itself is less, and the kerogen in the shale must be thermally cracked into oil and gas products and residual carbon by locally preheating the vincinity of injection well 2, to provide sufficient heat-generating donors for self-generating heat reactions.

Preferably, the preheating method of the self-generating heat in situ conversion formation of the medium-low mature and organic-rich shale comprises: injecting high-temperature inert gas for preheating, steam for preheating, electric heating for preheating, and injecting combustible gas and air mixture for combustion preheating.

Preferably, the preheating temperature of the vincinity of the injection well 2 of the self-generating heat, in-situ conversion of medium-low mature organic-rich shale reaches 300° C.

Preferably, the preheating radius of the vincinity of the injection well 2 of the self-generating heat, in-situ conversion of the medium-low mature and organic-rich shale reaches 2 meters.

Compared with the prior art, adopting the above measures has the following advantages: the invention only needs 300° C. and 2 meters for the formation preheating temperature and range for the formation preheating, which reduces the external heat input in the early stage, and reduces the related cost.

Injecting room temperature air at a constant flow rate into preheated injection well 2 to trigger an autogenous heat reaction, according to the difference in temperature profile and oxygen concentration in the course of advancing according to the reaction zones, a chemical reaction zone consisting of a residue zone 3, an autogenous heat zone 4, a thermal cracking zone 5 and a preheating zone 6 has been established in the formation, of which the autogenous heat zone 4 is the core area of the technique, all the oxygen reacts rigorously with residual carbon in this area to generate a large amount of heat. In the thermal cracking zone 5, at the front end along the displacement direction, no oxygen arrives, only heat can be reached by convective heat transfer, so that kerogen is thermally cracked to produce oil and gas in an oxygen-free environment, while the residual carbon is left in a solid form, to provide heat-generating donor for oxidation reaction in autogenous heat zone 4. The thermal cracking temperature of kerogen is between 300-450° C., so the temperature of thermal cracking zone 5 is generally within this temperature range. There is an interval between room temperature and 300° C. in the leading edge of thermal cracking zone 5, there is no reaction in the reaction zone but only has preheating effect on the formation, which becomes preheating zone 6. Kerogen residue zone 3 is the residual inorganic matter after the complete oxidation of the residual carbon. There is no heat-generating donor in this zone, so the exothermic reaction cannot occur.

Preferably, the bottom pressure of the injection well 2 of the self-generating heat, in-situ conversion of the medium-low mature and organic-rich shale is less than 20 MPa.

Preferably, the bottom pressure of production well 1 of the self-generating heat, in-situ conversion of the medium-low mature organic-rich shale is the same with the formation fluid pressure to prevent formation water from flowing out of the production well 1.

Preferably, the amount of air injected into the injection well 2 of the self-generating heat, in-situ conversion of the medium-low mature organic-rich shale is greater than 140 $m^3/(h \cdot m)$.

Preferably, when the volume fraction of $CO_2$ in the production well 1 of the self-generating heat, in-situ conversion of medium-low mature and organic-rich shale is less than 5%, the air injection amount should be increased to 560 $m^3/(h \cdot m)$ to prevent the autogenous heat reaction from stopping underground.

Preferably, when the pressure of injection well 2 of the self-generating heat, in-situ conversion of medium-low mature and organic-rich shale is continuously increasing, it indicates the blockage of oil and gas products in formation, which needs injecting high temperature air over 300° C. to remove the blockage.

EXAMPLES

Example 1

In this example, high-quality shale in Songliao Basin of China was selected as the research object, and the self-generating heat process for in-situ conversion of medium-low mature shale with rich organic matter was verified by numerical simulation method. The original effective porosity of target shale formation was 6.40%, the average TOC (total organic carbon) was 16.9%, the original state of the formation was 100% filled with formation water, and the thermal conductivity of the bedrock was $1.21 \times 10^5$ J/(m day° C.), the specific heat capacity of the bedrock was $1.50 \times 10^6$ J/($m^3$° C.). The mass fraction of carbon in kerogen and the molecular weight of kerogen were 71% and 14.7 g/mol, respectively. The porosity of kerogen in shale was 22.2%, the concentration of kerogen in pore was $6.34 \times 10^4$ mol/$m^3$, and the total porosity of this formation was 28.65%.

Because of the limited thickness of the layer rich in organic matter of the formation, the reversed nine-point well group was selected as the development well pattern, including eight injection wells 2 and one production well 1. The buried depth of the medium-low mature organic-rich shale formation was 500 m and the well spacing was 10 m, as shown in FIG. 2. Due to the dense medium-low mature shale formation and poor conductivity, large-scale volume fracturing and shock-wave induced fracturing were needed before mining. The fracture permeability produced by fracturing was 100 mDC and the matrix permeability was 0.01 mDC, the fracture spacing was 0.1 m.

In the first stage of self-generating heat, in-situ conversion of medium-low mature and organic-rich shale, nitrogen was injected at 500° C., the injection flow rate was 1250 $m^3$/day, the injection time was 1 day, and the bottom pressure of production well 1 was controlled at 5 MPa. In the second stage, normal temperature air was injected, the injection flow rate was still 1250 $m^3$/day, the injection time was until the temperature of production well 1 returned to normal temperature, and the bottom pressure of production well 1 was still controlled to 5 MPa.

Figure 3:
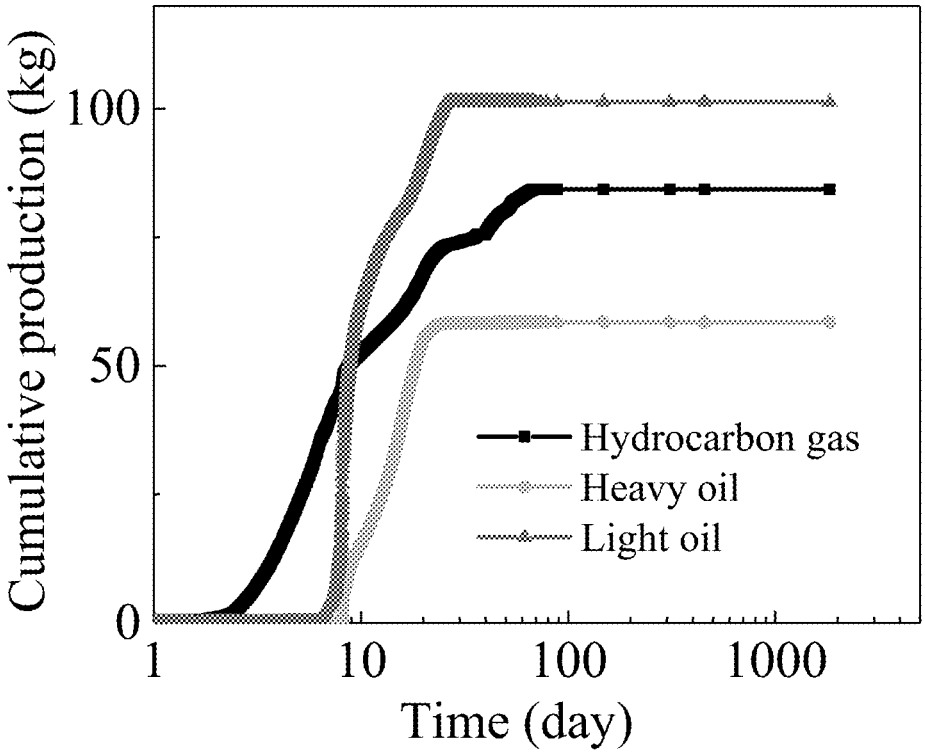
FIG. 3 is the cumulative oil and gas production diagram of self-generating heat, in-situ conversion of medium-low mature and organic-rich shale.
Figure 4:
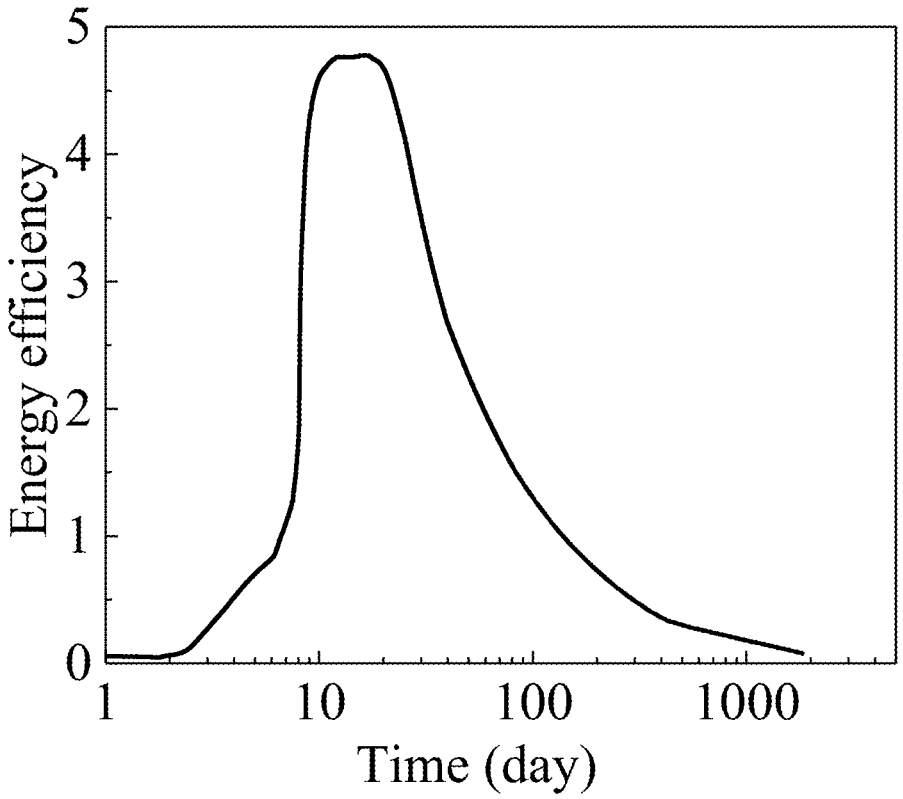
FIG. 4 is a graph showing energy return rate of self-generating heat, in-situ conversion of medium-low mature and organic-rich shale.

The autogenous heat reaction of medium-low mature and organic-rich shale was triggered successfully in the above production process, the temperature field advanced steadily with time, and the local temperature reached 1500° C. Meanwhile, kerogen was continuously transformed into oil-gas products and heat-generating donors, and oil-gas products were produced continuously from production well 1, while the heat-generating donors detained in the formation and underwent oxidation reaction with subsequent oxygen, releasing a large amount of heat. FIG. 3 shows the cumulative oil and gas production diagram of self-generating heat, in situ conversion of medium-low mature shale rich in organic matter. FIG. 4 shows the energy return rate of self-generating heat, in situ conversion of medium-low mature shale rich in organic matter. The results show that hydrocarbon gas, light oil and heavy oil were produced successively from production well 1 with the progress of self-generating heat and in-situ conversion. On the 27th day, light oil and heavy oil production stopped, and on the 80th day, hydrocarbon gas production stopped. The final total oil yield in this example reached 50%, which was much higher than that of conventional oil and gas field development. Another key indicator of in situ conversion is the rate of return on energy, which peaked at 4.75 on the 18th day in this example.

Example 2

In this example, the formation conditions, reservoir reconstruction and well pattern arrangement of oil shale were the same as those in Example 1. In the first stage of self-generating heat, in situ conversion, nitrogen was injected at 500° C., the injection flow rate was 1250 $m^3$/day, the injection time was 1 day, the bottom pressure of production well 1 was controlled at 5 MPa. In the second stage, normal temperature air was injected, and the injection flow rates were 1100 $m^3$/day, 1500 $m^3$/day, 2000 $m^3$/day and 4000 $m^3$/day respectively. The injection time was until the temperature of production well 1 returned to normal temperature and the bottom pressure of production well 1 was still controlled at 5 MPa.

Figure 5:
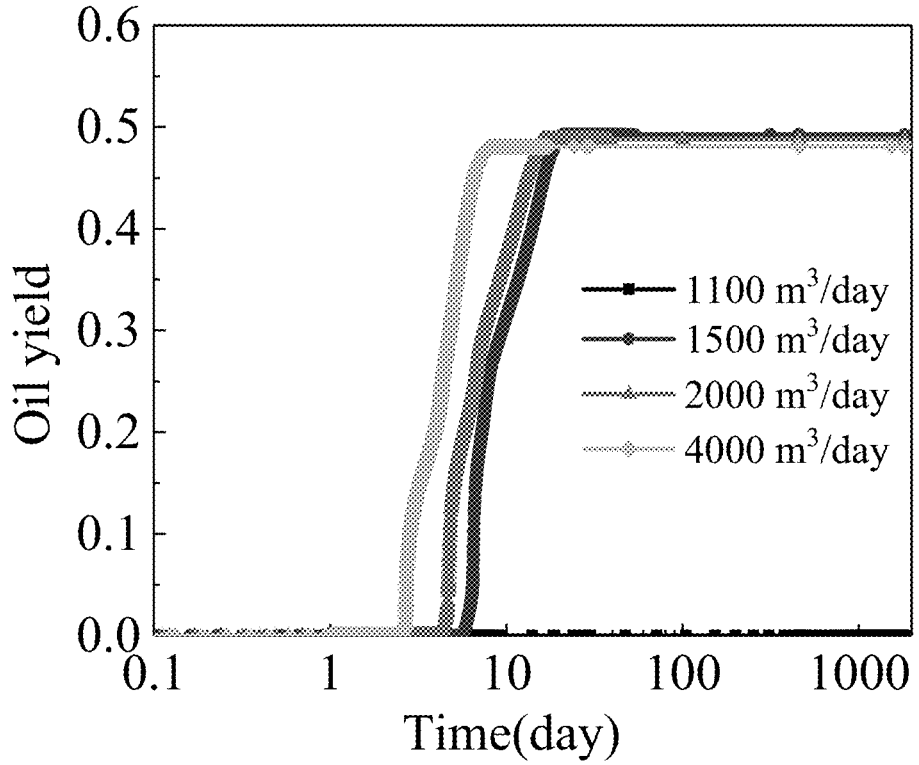
FIG. 5 shows the oil yield of self-generating heat reaction under different air injection rates.
Figure 6:
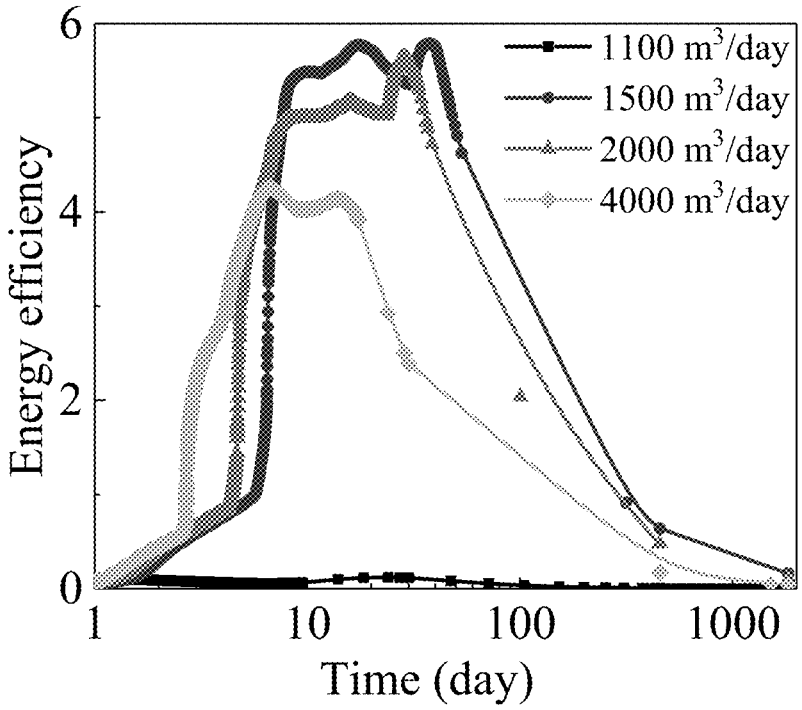
FIG. 6 is an energy efficiency diagram of self-generating heat reaction at different air injection rates.

As shown in FIG. 5, the oil yield of autogenous heat reaction of medium-low mature and organic-rich shale under different air injection flow rates was shown, and as shown in FIG. 6, the energy efficiency diagram of autogenous heat reaction of medium-low mature and organic-rich shale under different air injection flow rates was plotted. When the air inflow and outflow rate was 1100 $m^3$/day, the autogenous heat reaction cannot be triggered, and the oil yield and energy return rate were extremely low. When the flow rate exceeds 1100 $m^3$/day, the autogenous heat reaction was triggered successfully, but the oil yield did not increase with the increase of injection flow rate, which was about 47%. The rate of return on energy decreases with the increase of injection flow rate. As a larger injection flow rate requires a larger injection pressure, the rate of return on energy decreases with the increase of in-situ conversion external compressive energy injection.

Example 3

Figure 7:
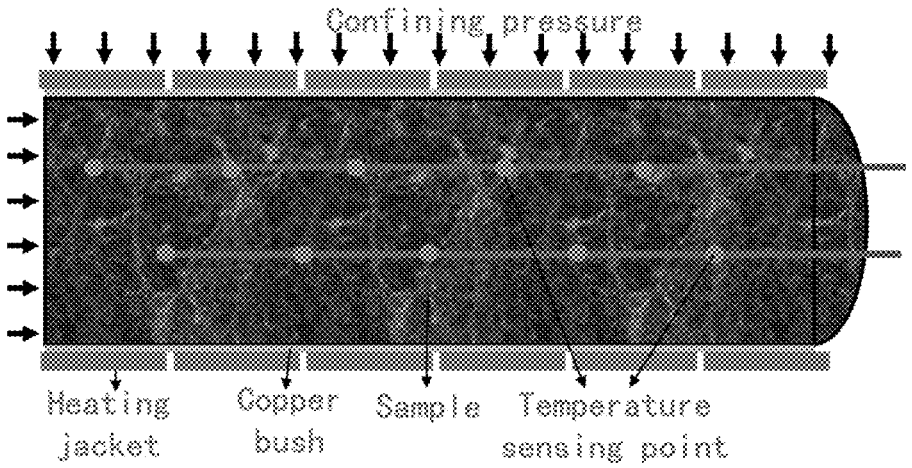
FIG. 7(*a*) is the schematic diagram of the structure of the experimental apparatus in Example 3 of the invention.
Figure 7:
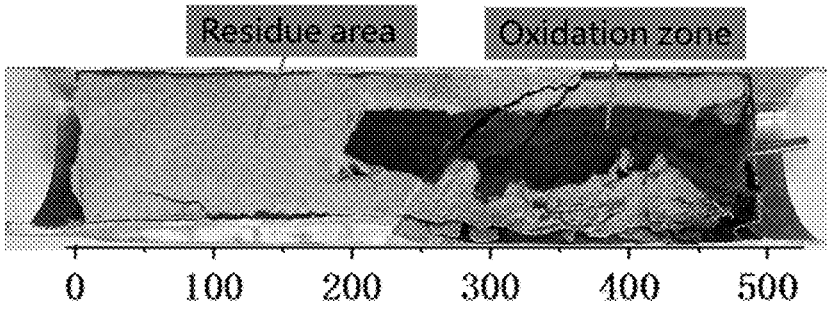

In order to study the effect of the self-generating process for in-situ conversion of medium-low mature and organic-rich shale provided by the present invention, one-dimensional self-generating heat, in-situ conversion simulation device was used to carry out corresponding simulation experiments. The simulation device was suitable for a sample with a diameter of 100 mm and a length of 500 mm, and the sample was wrapped radially in a purple copper sleeve, and perlite was filled outside of the purple copper sleeve for heat insulation treatment, and the a confining pressure can be applied outside the purple copper sleeve. At the same time, ten temperature measurement points were set up inside the sample along the displacement direction to test the temperature change of the sample during the self-generating heat, in-situ conversion experiment, as shown in FIG. 7(*a*).

The specific steps were as follows: firstly, oil shale particles with a mass of 6.5 kg, 30-80 meshes and 14% oil content were selected and pressed into a sample with a diameter of 100 mm and a length of 500 mm by a customized device at a pressure of 14 MPa, and an internal temperature sensor containing ten temperature measurement points was pressed into the sample at a pressure of 14 MPa during the sample pre-fabrication process.

Next, the sample was placed in an autogenous heat reaction holder. The sample was vented by a vacuum pump, the preheater temperature was set to 550° C., the back pressure valve was set to 5 MPa, the gas source of the booster pump was switched to nitrogen, the pressure was set to 10 MPa and the flow rate controller was set to 5 L/min. Next, nitrogen gas with high temperature at 550° C. was injected into the sample and the temperature reached 300° C. after 2.5 h at the first temperature measurement point of the internal temperature sensor. Finally, the air source of the booster pump was switched to air and room temperature air was injected to trigger an autogenous heat reaction inside the sample, and a chemical reaction zone consisting of a residue zone—autogenous heat zone—a cracking zone—a preheating zone was established. The experiment was stopped when the internal temperature of the sample dropped to room temperature. As shown in FIG. 7(*b*), it is a cross-sectional view of the sample after the one-dimensional autogenous heat in situ conversion simulation reaction. After the reaction, the sample was divided into a residual zone and an oxidation zone, in which the residual zone was mainly inorganic minerals after the oxidation of residual carbon, and the color was light, while the oxidation zone was mainly composed of residual carbon that has not undergone oxidation reaction, and the color was dark. As shown in FIG. 8, the temperature field evolution of one-dimensional autogenous heat in-situ conversion shows that after the sample end face was preheated to 300° C. for about 5 hours, room temperature air was injected, the sample end face temperature increased steeply and reached about 500° C. rapidly, and gradually warmed up along the axial direction of the sample, and the local temperature once reached 650° C. at one point, indicating that the oxidation reaction was successfully triggered and heated the whole sample to the cracking temperature.

Obviously, the above embodiments of the invention are only for illustration of the invention, and are not limitation to the method of implementation of the invention, there are other forms of change or change that can be made on the basis of the above description, and it is not possible to exhaust all the means of implementation here, any obvious changes or changes arising from the technical solutions of the invention are still within the scope of protection of the invention.

The invention claimed is:

1. A self-generating heat process for in-situ converting medium-low mature and organic-rich shale, the process comprises following steps:

Step 1: determining a target area of self-generating heat in-situ conversion of medium-low mature and organic-rich shale, formation conditions of the target area being that: vitrinite reflectance of the medium-low mature and organic-rich shale formation is from 0 to less than 1%, oil content of the medium-low mature and organic-rich shale formation is more than 5%, thickness of the medium-low mature and organic-rich shale formation is more than 15m, water content of the medium-low mature and organic-rich shale formation is from 0 to less than 5% and burial depth of the medium-low mature and organic-rich shale formation is from 0 to less than 3000m;

Step 2: arranging a well pattern in the target area as described in step 1, which adopts an inverse nine-point well pattern, wherein a ratio of an injection well pattern to a production well pattern being 3:1;

Step 3: reconstructing reservoir on the medium-low mature and organic-rich shale formation by volume fracturing and shock wave fracturing in turn to form a fracture network, and a ratio of permeability of fractures to permeability of matrix is less than 10000, the fracture spacing being from 0.1 meters to less than 0.5 meters;

Step 4: after reservoir reconstruction, preheating vicinity of the injection well of the medium-low mature and organic-rich shale formation, with preheating temperature reaching 300° C. and a preheating radius around the injection well reaching 2 m;

Step 5: after preheating, injecting ambient temperature air into the injection well, controlling a pressure at the bottom of the injection well to be from 5 MPa to less than 20 MPa, and ensuring that the pressure at the bottom of the production well is same with formation fluid pressure, with an injection of ambient temperature air, an autogenous heat reaction being triggered, and along a direction of displacement, a chemical reaction zone consisting of a residue zone, an autogenous heat zone, a cracking zone and a preheating zone in sequence is formed in the medium-low mature and organic-rich shale formation between the injection well and the production well, heat being released by oxidation reaction of residues generated after kerogen thermal cracking so as to realize convection heating the medium-low mature and organic-rich shale formation, oil and gas products from pyrolysis of kerogen entering the production wells through fractures, and being lifted to ground, wherein the reverse nine-point well pattern includes at least one well unit, each of which includes a production well located at the center of a rectangle, and an injection well located at four vertex positions of the rectangle and four center positions of four edges of the rectangle, wherein in Step 5, an air injection amount is from greater than 140 $m^3/(h \cdot m)$ to 560 $m^3/(h \cdot m)$, and an air injection time is until the temperature of the production well reaches ambient temperature, wherein in Step 5, when a volume fraction of $CO_2$ in the production well is from 0 to less than 5%, it is necessary to increase the amount of air injected to 560 $m^3/(h \cdot m)$.

2. The self-generating heat process for in-situ converting medium-low mature and organic-rich shale according to claim 1, wherein when the medium-low mature and organic-rich shale formation has a thickness of more than 50 meters, vertical wells are adopted; when the medium-low mature and organic-rich shale formation has a thickness of from 15 meters to less than 50 meters, horizontal wells are adopted.

3. The self-generating heat process for in-situ converting medium-low mature and organic-rich shale according to claim 1, wherein in Step 4, the preheating the vicinity of the injection well of medium-low mature and organic-rich shale formation includes: preheating by injecting inert gas, steam preheating, electric preheating or preheating by combustion of a mixture of combustible gas and air.

4. The self-generating heat process for in-situ converting medium-low mature and organic-rich shale according to claim 1, wherein a residue zone, an autogenous heat zone, a thermal cracking zone and a preheating zone are divided according to difference of temperature profile and oxygen concentration during an advancing direction in a reaction region; and wherein in the autogenous heat zone, all oxygen reacts with residual carbon, and no oxygen reaches the thermal cracking zone at the front end along a direction of displacement, only heat reaches the zone through convective heat transfer, so that the kerogen is thermally cracked to produce oil and gas in an oxygen-free environment, while the residual carbon remains in a solid form, which provided heat donor for an oxidation reaction in the autogenous heat zone, the temperature of the thermal crack zone ranges from 300° C. to 450° C., the temperature in the preheating zone is between room temperature and 300° C., no reaction occurs in the preheating zone, which only preheats the formation, the residue zone is inorganic matter left after the residual carbon is completely oxidized and there is no heat donor in this zone and exothermic reaction cannot occur.

5. The self-generating heat process for in-situ converting medium-low mature and organic-rich shale according to claim 1, wherein in Step 5, when the oil and gas product in the medium-low mature and organic-rich shale formation is blocked, high-temperature air having a temperature in a range from 300° C. to 650° C. is injected into the injection well to remove blockage.

* * * * *